US012365438B2

(12) United States Patent
Julliand et al.

(10) Patent No.: US 12,365,438 B2
(45) Date of Patent: Jul. 22, 2025

(54) COUNTER ROTATING PROPELLER POD MECHANICAL ARRANGEMENT

(71) Applicant: GE Energy Power Conversion France, Villebon-sur-yvette (FR)

(72) Inventors: Lionel Julliand, Belfort (FR); Jorgen Jorde, Bergen (NO); Theo Grall, Belfort (FR); Mathieu Bittermann, Champigneulles (FR); Nicolas Leboeuf, Champigneulles (FR); Henri Baerd, Villebon-sur-yvette (FR)

(73) Assignee: GE Energy Power Conversion France, Villebon-sur-Yvette (FR)

( * ) Notice: Subject to any disclaimer, the term of this patent is extended or adjusted under 35 U.S.C. 154(b) by 480 days.

(21) Appl. No.: 17/715,000

(22) Filed: Apr. 6, 2022

(65) Prior Publication Data

US 2023/0234691 A1 Jul. 27, 2023

Related U.S. Application Data

(60) Provisional application No. 63/302,536, filed on Jan. 24, 2022.

(51) Int. Cl.

| | |
|---|---|
| ***B63H 21/30*** | (2006.01) |
| ***B63H 5/10*** | (2006.01) |
| ***B63H 21/17*** | (2006.01) |
| ***B63H 23/32*** | (2006.01) |
| ***B63H 23/35*** | (2006.01) |

(52) U.S. Cl.

CPC ..... *B63H 21/30* (2013.01); *B63H 5/10* (2013.01); *B63H 21/17* (2013.01); *B63H 23/321* (2013.01); *B63H 23/35* (2013.01); *B63H 2021/307* (2013.01); *B63H 2023/323* (2013.01)

(58) Field of Classification Search

CPC ..... B63H 21/30; B63H 21/17; B63H 5/10; B63H 23/321; B63H 23/35; B63H 2021/307; B63H 2023/323

See application file for complete search history.

(56) References Cited

U.S. PATENT DOCUMENTS 3,167,361 A * 1/1965 Snapp ..... B63H 23/321 440/82
5,947,779 A * 9/1999 Heideman ..... B63H 5/125 440/58
7,018,249 B2 3/2006 Ries et al.
(Continued)

FOREIGN PATENT DOCUMENTS

FR 2788032 A1 * 7/2000 ..... B63H 21/17

*Primary Examiner* — Stephen P Avila

(57) ABSTRACT

Provided is a pod propulsion system including first and second counter rotating propellers for propelling a marine vessel first and second propeller modules, each including an electric motor having a driving-end configured to rotate the first and second propellers, respectively. Also included are first and second gondolas, each (i) for housing a respective one of the first and second electric motors and (ii) including a boltable interface formed along a lengthwise direction of an extremity of the gondola. A strut (i) connects the first and second gondolas to a hull of the marine vessel (ii) including first and second boltable interfaces. Each of the boltable interfaces of the strut is configured to form a bolted joint interface with a corresponding one of boltable interfaces of the first and second gondolas.

17 Claims, 9 Drawing Sheets

(56) References Cited

U.S. PATENT DOCUMENTS

| | | | | |
|---|---|---|---|---|
| 10,759,511 | B2 | 9/2020 | Mudupu et al. | |
| 2003/0194922 | A1* | 10/2003 | Van Dine ..... | B63H 1/16<br>440/6 |
| 2005/0009418 | A1 | 1/2005 | Ries et al. | |

* cited by examiner

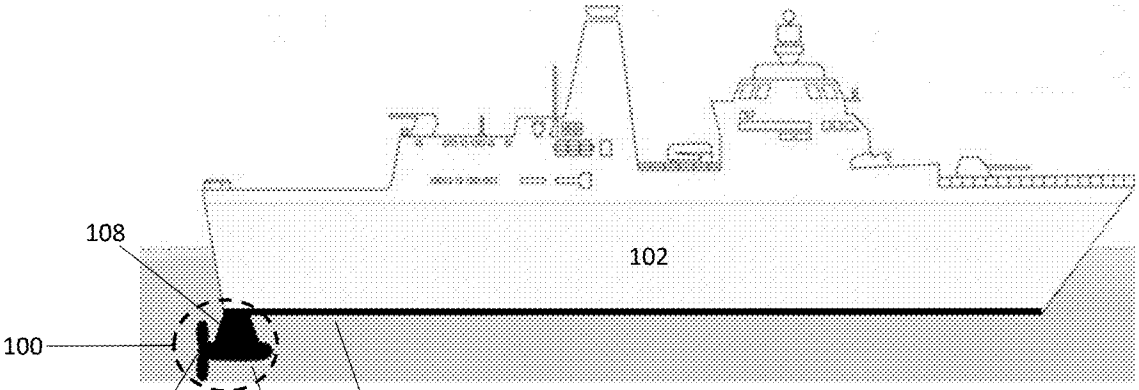
FIG. 1A
(Conventional)

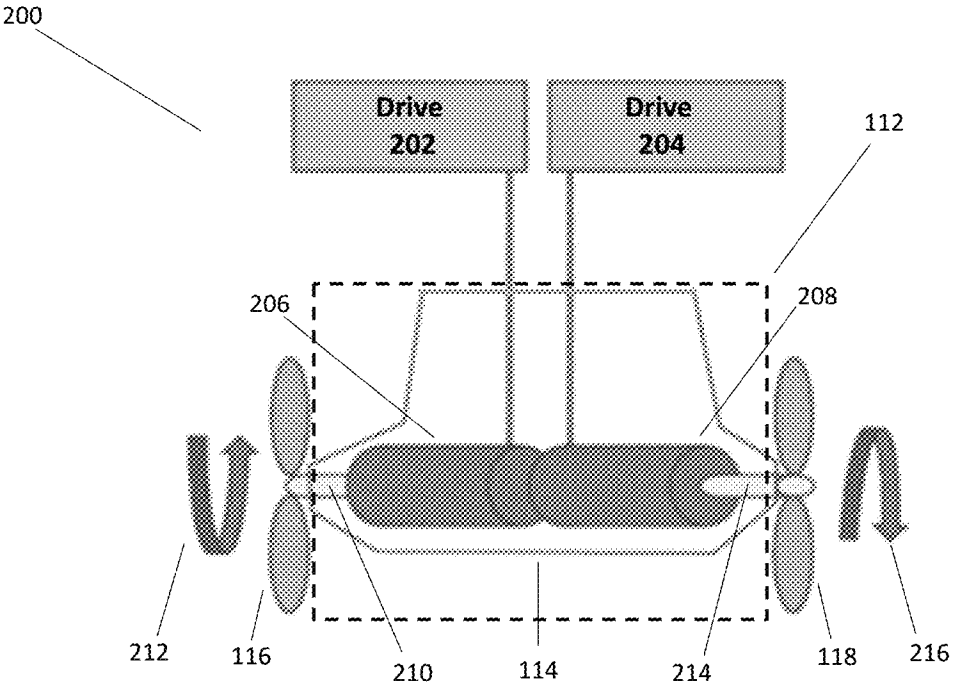
FIG. 2
(Conventional)

COUNTER ROTATING PROPELLER POD MECHANICAL ARRANGEMENT

CROSS-REFERENCE TO RELATED APPLICATIONS

This application claims benefit to U.S. Provisional Patent Application No. 63/302,536, filed on Jan. 24, 2022, the disclosure of which is incorporated herein in its entirety by reference.

FIELD OF TECHNOLOGY

The following relates generally to a counter-rotating propeller (CRP) pod propulsion systems for marine vessels. More specifically, the following relates to arrangements and configuration of internal components of the pod propulsion system.

BACKGROUND

Conventional marine vessel pod propulsion systems suffer shortcomings in several areas. For example, conventional pod propulsion systems tend to be heavier and larger than other propulsion system approaches given the size of the internal components. Also, the conventional pod propulsion systems' generally lack redundancy.

Within various types of pod propulsion systems, CRP pods can offer improved efficiencies over single-screw (i.e., single propeller) pods. As understood by those of skill in the art, CRP pods include counter rotating propellers—one at each end of the pod. By way of background, some arrangements also provide two counter-rotating propellers at one end.

CRP pods reduce the hydrodynamic flow rotational losses, after the propeller, of single-screw pod systems. CRP pods are also designed to include two electric motors along and with two corresponding motor drives that enable independent operation of the two motors. Conventional CRP pods, however, are generally penalized by weight and size as they require two independent shaft lines (i.e., two sets of bearings for each shaft). Also, the independent operation of conventional two-motor CRP pods generally fails to provide any significant redundancy, for example, in the event of a motor or drive failure.

SUMMARY

Given the aforementioned deficiencies, a need exists for a CRP pod propulsion system for a marine vessel that provides higher efficiencies than the existing CRP pods, offers reductions in size and weight, and provides redundant operation in the event of a critical failure in one of the electric motors, a corresponding motor drive, or similar.

In certain circumstances, embodiments of the present disclosure provide a pod propulsion system including first and second counter rotating propellers for providing thrust to propel a marine vessel. The pod propulsion system includes a first electric motor (i) for rotating the first propeller and (ii) electrically coupled to a first drive, the first drive being configured to control the first motor and a second electric motor (i) for rotating the second propeller and (ii) electrically coupled to a second drive, the second drive being configured to control the second motor. The first and second drives respectively control the first and second motors interdependently.

The embodiments are unique in combining CRP pod propulsion system hydrodynamics with two independent, dismountable, and compact propulsion modules fixed to a strut. These arrangements are lighter in weight, easier to manufacture, and easier to test. The lighter weight results from enhanced permanent magnet (PM) motor technology, other e-motors, and system construction. Also provided are reduced module outline dimensions, especially length, due to a single bearing arrangement on propulsion modules within the CRP pod propulsion system.

Full redundancy of CRP pod systems results from independent, and interdependently operating, propulsion modules. Fully redundant operation is derived from two independent sets of active parts and powerline between the drive and motor arrangement. In the event of a failure of one propulsion module, the second propulsion module can remain 100% mechanically and electrically operable.

In the event of a failure of one drive, both the propulsion modules can be operated simultaneously (up to 100% in some cases). Additionally, the embodiments spread the global power of the CRP pod propulsion system across two motors, ultimately enabling construction of motors and gondolas having smaller diameters and better CRP performance. There is also a unicity of power supplies per motor (e.g., one drive per motor, one drive for two motors).

The embodiments are very efficient, improving CRP pod propulsion hydrodynamic performance by around 3-5%. The embodiments also provide improved industrialization by virtue of using more active, smaller, modularized, and dismountable components. The use of smaller and modularized components improves maintainability and reduces the reliance on intricate testing facilities since many of the modules can be tested individually.

In one exemplary system, a single bearing along the shaft line of each motor results in a shorter and more compact motor module. The more compact modules are smaller, lighter, and increase hydrodynamic efficiency.

These and other aspects of the present disclosure will become apparent from following description of the embodiments taken in conjunction with the following drawings and their captions, although variations and modification therein may be affected without departing from the spirit and scope of the novel concepts of the disclosure.

BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are only for purposes of illustrating the embodiments and are not to be construed as limiting the disclosure. Given the following enabling description of the drawings, the novel aspects of the present disclosure should become evident to a person of ordinary skill in the relevant art(s).

FIG. 1A is a high-level illustration of a conventional single-screw pod propulsion system in a marine vessel.

FIG. 2 is a detailed illustration of a conventional CRP pod propulsion system.

DETAILED DESCRIPTION

Figure 1B:
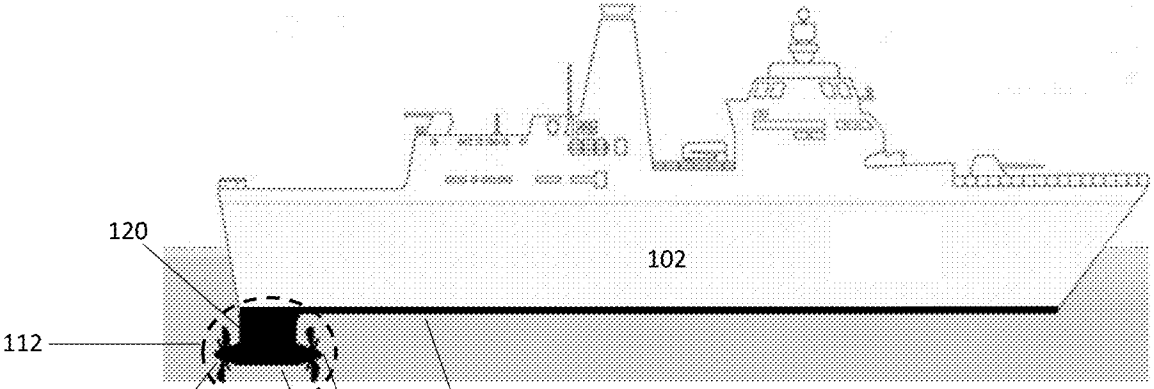
FIG. 1B is a high-level illustration of a conventional CRP pod propulsion system in the marine vessel depicted in FIG. 1A.

While the illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

The present disclosure describes embodiments of a CRP pod propulsion system for providing thrust to propel a marine vessel. One illustrative embodiment includes a 5-25 megawatt (MW) pod propulsion system with an internal arrangement providing maintainability for a range of pod components. An exemplary CRP pod system includes propulsion modules made with canned motors for simplified industrialization, testing, reduced weight, and an exchange of active parts. Each propulsion module includes an electric motor housed in a gondola. The gondola has a bolted interface and is configured for water-tight connection with a strut. The strut connects the gondola to the hull of the marine vessel.

Obtaining maximum propulsion module efficiency is an important goal during module design. Maximum efficiency occurs as a result of trade-offs between at least three interrelated factors. Included among these factors are hydrodynamic efficiencies, motor solution efficiency, and pod auxiliary efficiencies. By way of example, auxiliary system may include (e.g., cooling systems, steering systems, and other supporting systems.

In one exemplary embodiment, propulsion module efficiency is increased by providing gondolas with smaller diameters. The smaller diameter gondolas can translate to significantly higher CRP propulsion system hydrodynamics. By way of example, pod thrust is linked to motor torque, which depends on motor active parts volume. Motor manufacturing depends on maximum core length. By having two motors in the gondola, cumulated motor length is increased, thus reducing the motor diameter. The one exemplary embodiment also includes reduced strut widths and reduced wet surfaces.

For PM motor with the same diameter and core length, efficiency is typically 2% above synchronous and asynchronous motor efficiencies due to reduced rotor losses. The pod auxiliary efficiency depends on consumption of lubrication, motor cooling etc. Motor technology, motor power density and motor cooling type influence hydrodynamic shape and hydrodynamic efficiency. The embodiments optimize the trade-offs between hydrodynamic performance, motor solutions, and auxiliary efficiencies.

With large motors, it can be more difficult to absorb shocks. It is better to have smaller and lighter motors to deal with shock and vibration. Therefore, it is better to split the power across multiple motors (e.g., two motors) inside the gondola. Accordingly, the embodiments provide pods with the most compact active parts, as illustrated in FIGS. 1A-8, and the corresponding discussion below.

FIG. 1A is a high-level illustration of a conventional single-screw pod propulsion system 100 for use in a marine vessel 102. The single-screw pod propulsion system 100 includes a propulsion module 104, including a motor (not shown). A single propeller 106 is attached to a shaft at a driving-end of the motor. The propulsion module 104 is coupled to a strut 108 for attaching the propulsion system 100 to a hull 110 of the marine vessel 102. A significant deficiency of the conventional single-screw pod propulsion system 100 relates to the hydrodynamic flow of its single propeller 106.

Specifically, the hydrodynamic flow after the single propeller 106 has a rotational component representing a loss to the thrust produced by the propeller 106. A counter-rotating propeller, after the first propeller, is provided in CRP pod propulsion systems. The counter-rotating propeller reduces the rotational losses to near zero, improving the overall performance of the system.

FIG. 1B is a high-level illustration of a conventional CRP pod propulsion system 112 affixed to the marine vessel 102. The CRP pod propulsion system 112 includes at least two electric motors (discussed in greater detail below). A propeller 116 and a corresponding counter-rotating propeller 118 are connected to respective shafts at driving-ends of the respective motors.

A strut 120 section connects the motors and the propellers 116 and 118 to the hull 110 of the ship 102. The counter-rotating propeller 118, rotating in one direction, substantially eliminates the rotational losses produced as the propeller 116 rotates in an opposite direction. As a result, the CRP pod propulsion system 112 operates more efficiently than the pod propulsion system 100. However, the CRP pod propulsion system 112 suffers at least one critical shortcoming: it lacks redundancy.

The CRP pod propulsion system 112 fails to offer any significant redundancy in the event of a critical component failure, such as the complete failure of an electric motor or a motor drive. FIG. 2 is a detailed illustration of a conventional propulsion arrangement 200 including the CRP pod propulsion system 112 of FIG. 1B, coupled to motor drives 202 and 204.

Electric motors 206 and 208 are electrically coupled to the motor drives 202 and 204, respectively. By way of example, and as well understood by a person of skill in the art, the motor drives 202 and 204 provide control signals, in varying frequencies, to control the respective electric motor's speed, torque, etc. In FIG. 2, the drive 202 provides control signals to the electric motor 206. The electric motor 206 provides power, via a shaft 210, to drive the propeller 116 in a rotational direction 212. Similarly, the drive 204 provides control signals to the electric motor 208. The electric motor 208 provides power, via a shaft 214, to drive the propeller 118 in a rotational direction 216.

In the propulsion arrangement 200, the drives 202 and 204 operate to independently control the corresponding motors 206 and 208. For example, the drives 202 and 204 are configured to apply power separately. Consequently, the drives 202 and 204 drive the motors 206 and 208 completely independently and at different revolutions/minute (RPMs). If, for example, the drive 204 fails during operation, the functionality of both the drive 204 and the motor 208 will be lost.

Figure 3B:
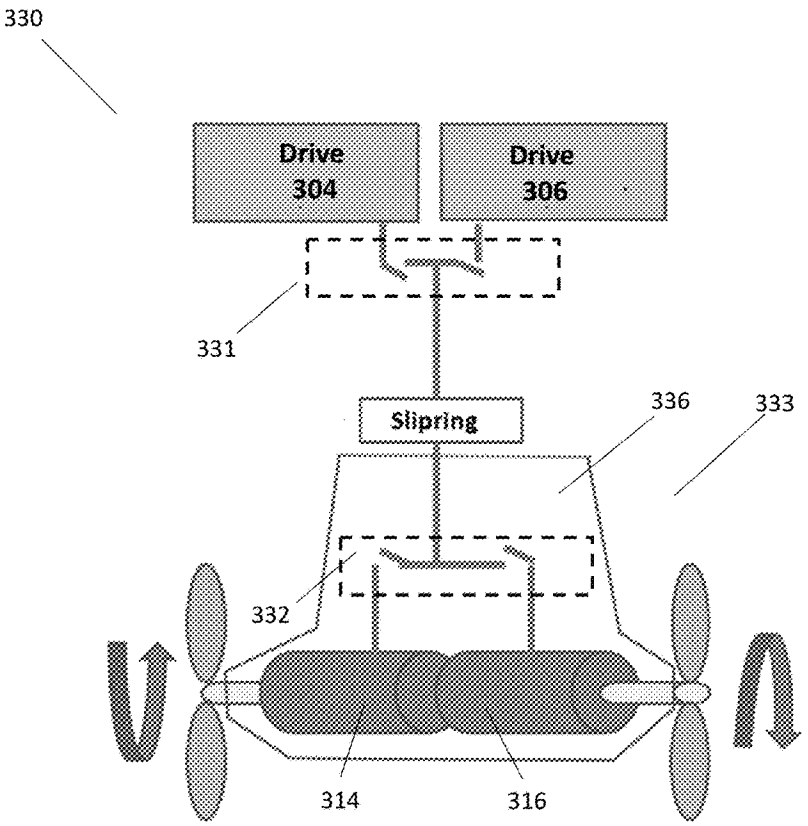
FIGS. 3A and 3B are illustrations of CRP pod propulsion systems constructed in accordance with first and second embodiments of the present disclosure.
Figure 3A:
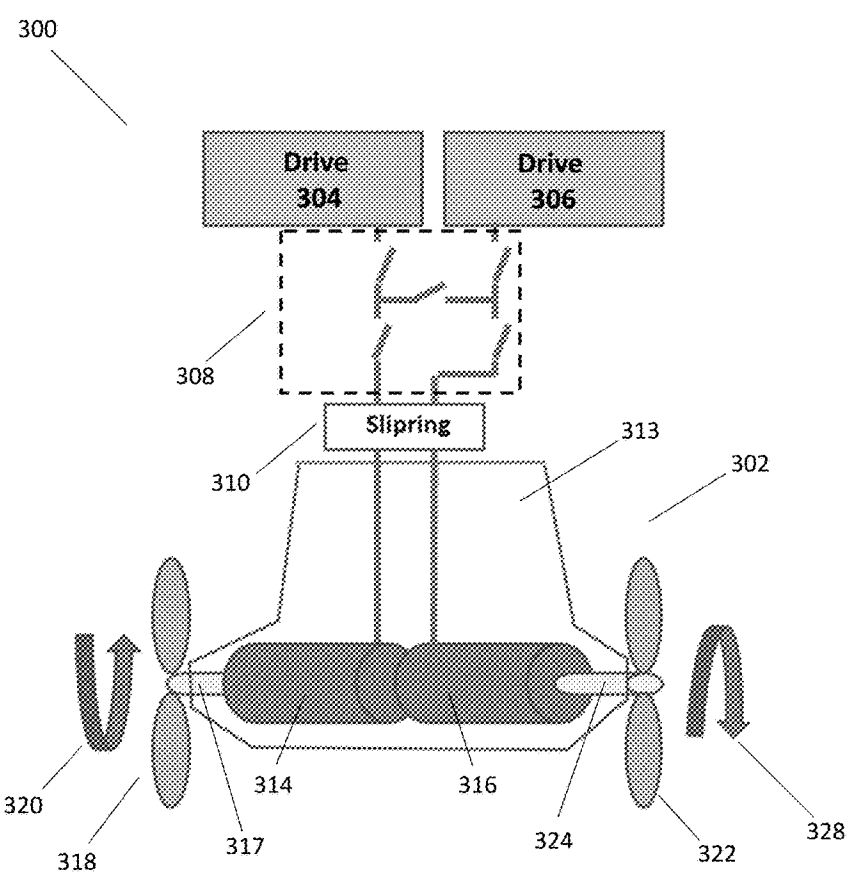

FIG. 3A is an illustration of a smaller and lighter weight propulsion arrangement 300, constructed to provide redundancy in accordance with a first embodiment of the present disclosure. In the propulsion arrangement 300, a CRP pod propulsion system (CRP Pod) 302 is electrically connected to motor drives 304 and 306.

The motor drives 304 and 306 are configured for coupling to the CRP Pod 302 by way of a disconnector (i.e., switch) 308 and a slip-ring 310. As well understood by persons of skill in the art, the slip-ring 310 provides a mechanical connection to permit rotation of the CRP Pod 302. In the embodiments, the slip-ring 310 also permits transmission of electrical power, and other signals, between the stationary disconnector 308 and the CRP Pod 302.

The CRP Pod 302 includes a strut 313 and electric motors 314 and 316. The strut 313 connects the electric motors 314 and 316 to the slip-ring 310, and ultimately to the hull of a marine vessel. The electric motors 314 and 316 are configured for coupling to the drives 304 and 306. A driving-end of the electrical motor 314 is connected to a propeller 318 via a shaft 317. The motor 314 produces thrust to rotate the propeller 318 in a rotational direction 320. Similarly, a driving-end of the electrical motor 316 is connected to a propeller 322 via a shaft 324. The motor 316 produces thrust to rotate the propeller 322 in a rotational direction 328.

By way of example only, and not limitation, the drives 304 and 306 are variable frequency drives that facilitate speed and direction control of the electric motors 314 and 316. The drives 304 and 306 and are interconnected to operate interdependently via the switch 308. The interdependent operation enables the drives 304 and 306 to keep the propellers 318 and 322 spinning at substantially the same RPM. The interdependency also provides redundancy.

In one example of redundancy, both of the drives 304 and 306 can simultaneously drive one, or both, of the motors 314 and 316. Conversely, each of the drives 304 and 306 can separately drive both of the motors 314 and 316. Accordingly, if either of the drives 304 and 306 is inoperable, the other drive can continue to control both motors 314 and 316 simultaneously. In some cases, the motors 314 and 316 can operate at a reduced level of power (e.g., a 50% reduction) when one of the drives 304 or 306 fails. In other cases, the motors 314 and 316 can operate simultaneously at full power (e.g., if the drives 314 and 316 are oversized) Thus, and in accordance with the foregoing, one of the drives 304 or 306 can power both of the motors 314 and 316 at the same time.

FIG. 3B is an illustration of a smaller and lighter weight propeller arrangement 330 constructed to provide redundancy in accordance with a second embodiment of the present disclosure. The propeller arrangement 330 is substantially equivalent to the propeller arrangement 300. The distinction is in the design of switches 331 and 332. The propeller arrangement 330 is an alternative approach for providing redundancy, based on the way the drives 304 and 306 are configured and/or how the switches 331 and 332 are used. In the propeller arrangement 330, a CRP Pod 333 is electrically connected to drives 304 and 306 of FIG. 3A.

In the propeller arrangement 330, the electrical drives 304 and 306 are configured for electrical coupling to the CRP Pod 333 and to the motors 314 and 316 by way of the two switches 331 and 332, instead of the single switch 308 of FIG. 3A. In FIG. 3B, one switch 332 is positioned internal to the CRP Pod 333 and another switch 331 is positioned externally. Using the switches 331 and 332, power can be provided to power only one of the motors 314 and 316 (separately). Alternatively, the switches 331 and 332 can provide power to both of the motors 314 and 316 (simultaneously).

Figure 4A:
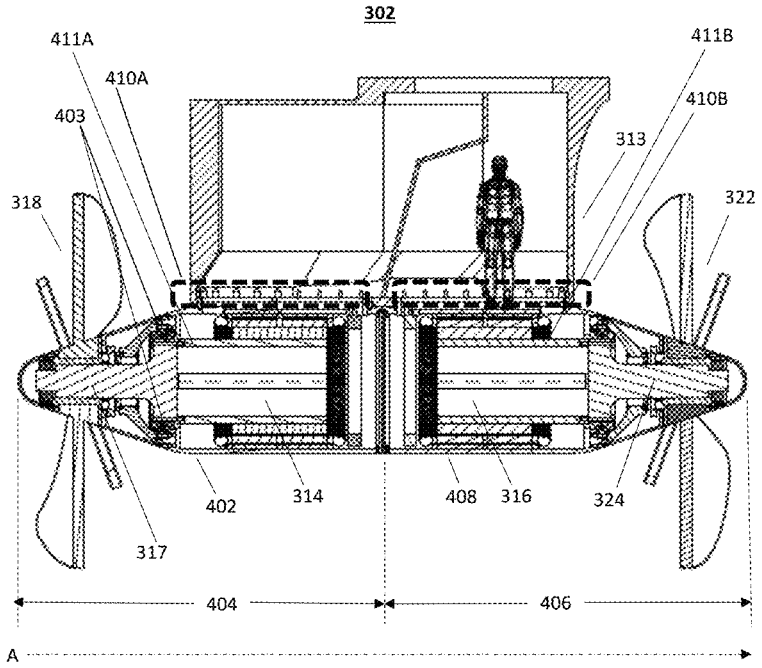
FIG. 4A is a detailed cross-sectional view of the CRP pod propulsion system depicted in FIG. 3A.

FIG. 4A is a detailed cross-sectional view of the CRP Pod 302 depicted in FIG. 3A. In the embodiments, sections of the CRP Pod 302 (e.g., propeller modules) comprise similar active parts that provide modularity and correspondingly, a reduction in the pod's weight. As depicted in FIG. 4A, the motor 314 is encased within a gondola 402 formed of a compact watertight fuselage, or canister. Within the gondola 402, a rotor of the electric motor 314 is detachably connected to a single bearing 403 to drive the shaft 317. The shaft 317 is coupled to the propeller 318. Rotor rims 411A and 411B are bolted to the propeller shafts 317 and 324, respectively.

Figure 4B:
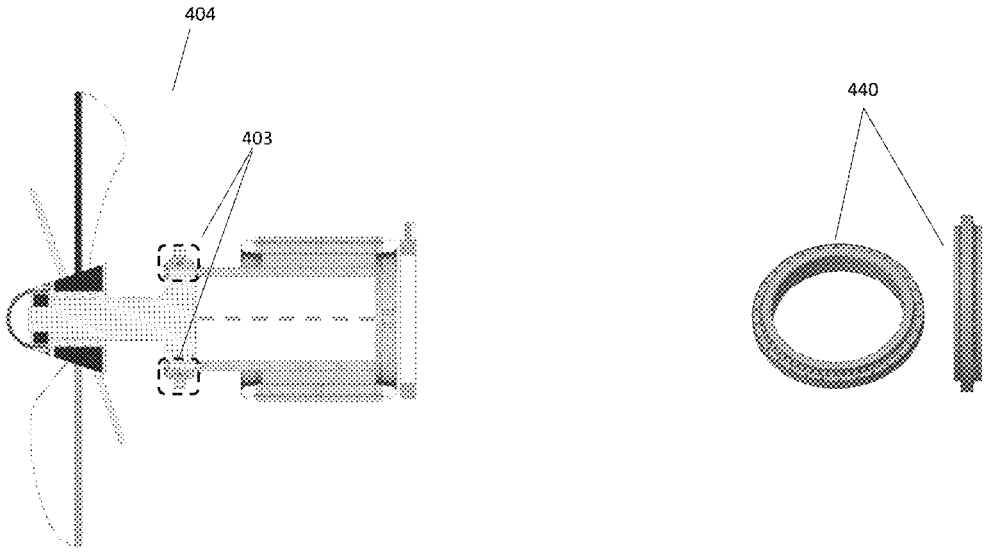
FIG. 4B is a more detailed view of the single bearing shaft line depicted in FIG. 4A.

FIG. 4B is a more detailed view of the single bearing 403 within the propeller module 404 depicted in FIG. 4A. The single slewing bearing 403 is capable of accommodating loads in five degrees of freedom. For example, the single bearing 403 is capable of handling axial, radial, and lever arm loads. In one exemplary embodiment, the single bearing 403 can be a slewing bearing 440, although the present disclosure is not so limited.

By way of background, conventional pod propulsion systems generally provide multiple bearings along the shaft line. In the CRP Pod 302, the single bearing 403 is configured to accommodate axial, thrust, radial, and lever arm loads for compact arrangement, maximization of motor length for a given gondola length, and less auxiliaries and monitoring.

In one example, the single bearing 403 handles thrust from the propeller 318, while also handling a radial load resulting from the weight of the propeller 318 on one side, and the weight of the motor 314 on the other side. Using the single bearing 403, further reduces the weight of the propeller module 404.

If problems develop with one of the propeller modules 404 or 406, an axial shaft locking system, inside each propeller module 404 and 406, can be used to temporarily lock the shaft lines (not shown) for safe return to port (SRTP).

Returning to FIG. 4A, the motor 314 and the propeller 318 together form a propeller module 404. A propeller module 406 includes the motor 316, encased within a gondola 408, and the propeller 322. Other components within the propeller module 406 are substantially identical to components described above in reference to the propeller module 404. Accordingly, the following descriptions describing the propeller module 404 also apply to the propeller module 406.

The motor 314, within the propeller module 404, can be a canned motor for simplified industrialization, testing, reduced weight, and exchange of active parts. As used herein, a canned motor is self-contained and packaged within a compact outer shell. By way of example only, and not limitation, canned motors can also be cooled by an independent flow of seawater. The propeller modules 404 and 406 integrate electric motors 314 and 316 (i.e., propulsion motors) that can be shrink fitted for thinner and smaller diameter gondolas 402 and 408. This approach is suitable for producing low torque density motors up to around 80 kilonewtons per cubic meter (kNm/m3).

Active parts within the propeller modules 404 and 406 reduce their weight and helps reduce the size (and diameter) of the corresponding gondolas 402 and 408. The active parts provide for more compact construction, and eases manufacturing challenges. In this manner, the strut 313 can be manufactured separately from the gondolas 402 and 408.

For example, in the CRP Pod 302 of FIG. 4A, the strut 313 is connectable to the gondolas 402 and 408 through horizontally aligned boltable interfaces 410A and 410B along an extremity of each of the gondolas 402 and 404. In FIG. 4A, the boltable interfaces 410A and 410B are horizontally aligned with (i.e., substantially parallel to) a lengthwise direction (A) of the propeller modules 404 and 406.

Figure 6:
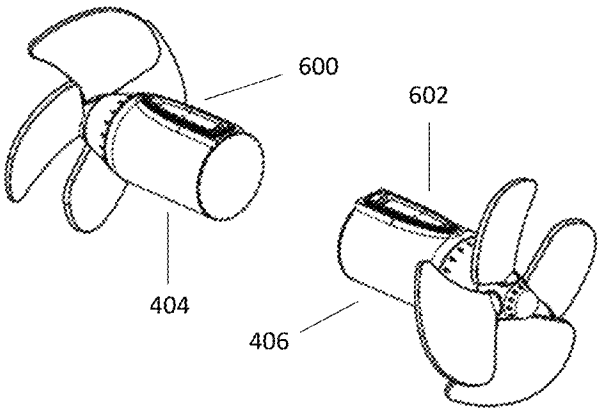
FIG. 6 is an illustration of the pod propulsion modules in the CRP pod propulsion system depicted in FIG. 4A.
Figure 5:
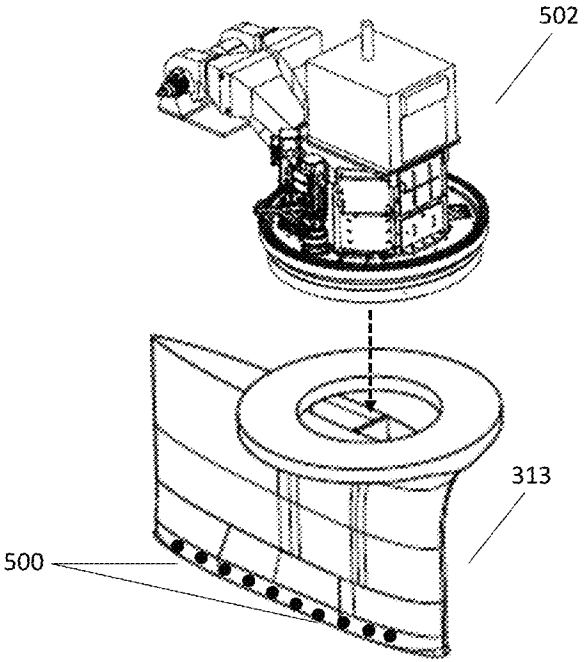
FIG. 5 is an illustration of a strut and steering module associated with the CRP pod propulsion system depicted in FIG. 4A.
Figure 7:
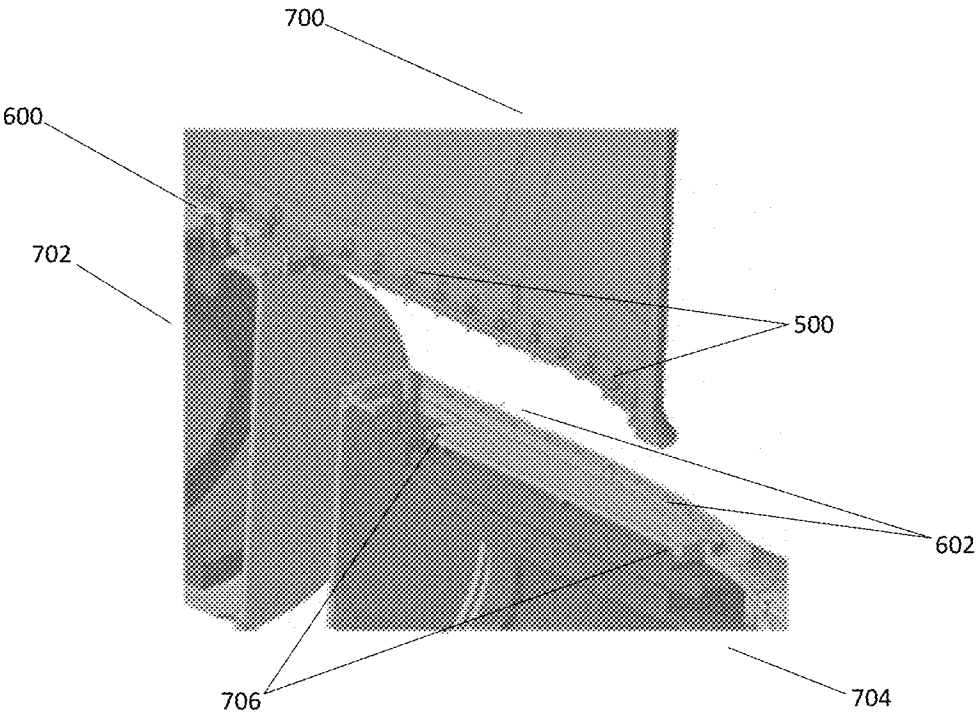
FIG. 7 is a detailed cross-sectional view of an exemplary bolted interface for a strut and at least one propeller module in accordance with the embodiments.

The horizontal alignment provides better air and cable access to the active parts inside the gondolas 402 and 408. Although bolt type fasteners are depicted in FIG. 4A, other fastening mechanisms known to those of skill in the art would be suitable and within the scope of the present disclosure. FIGS. 5-7 provide detailed illustrations of subsections of the boltable interfaces 410A and 410B.

Figure 4C:
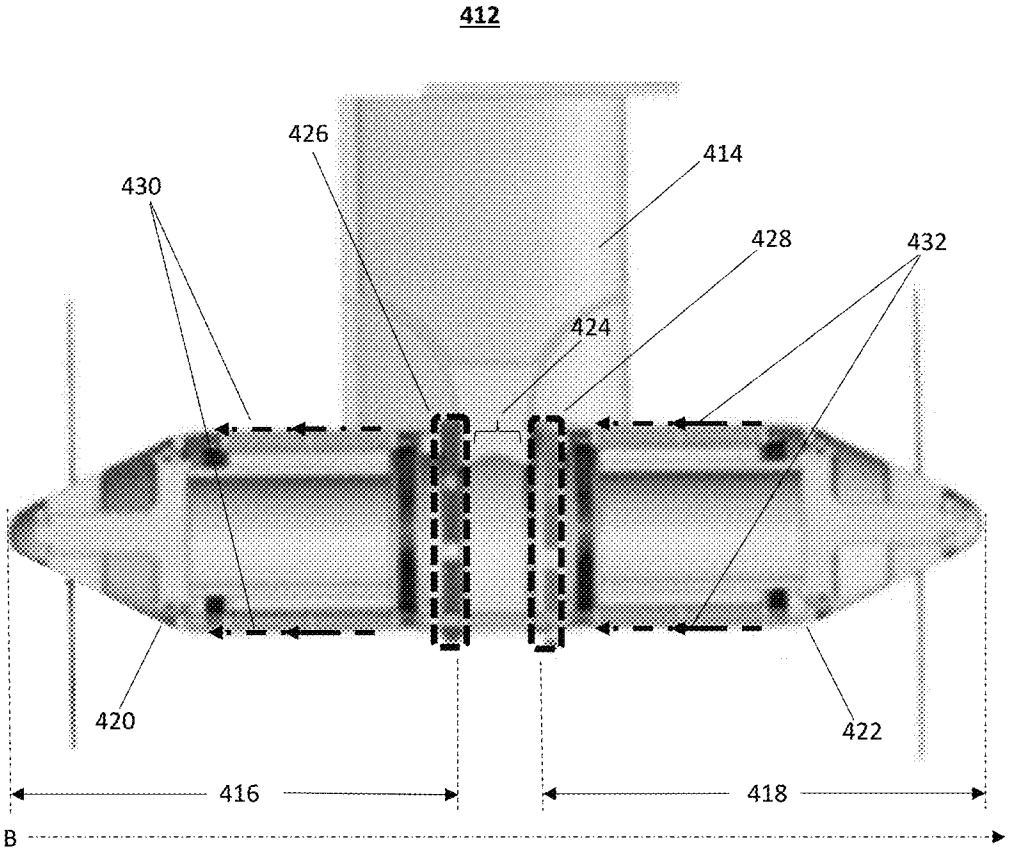
FIG. 4C is a more detailed cross-sectional view of the CRP pod propulsion system depicted in FIG. 4A.

FIG. 4C is a cross-sectional view of a CRP pod propulsion system 412 in an alternative embodiment that includes vertically aligned connectable interfaces. For example, the CRP pod propulsion system 412 includes a strut 414 connectable to propeller modules 416 and 418. The propeller modules 416 and 418 include motor gondolas 420 and 422, respectively. The strut 414 includes a vertically oriented connecting section 424. The vertically oriented connecting section 424 is connectable to the gondolas 420 and in 422. The connection is formed through vertically aligned boltable interfaces 426 and 428 along extremities of each of the gondolas 420 and 422, respectively.

In being vertically aligned, boltable interfaces 426 and 428 are substantially orthogonal to a lengthwise direction (B) of the propeller modules 416 and 418. The propulsion system 412 can circulate sea water for cooling to internal active parts a full 360 degrees around an outer shell, along circulation paths 430 and 432 outside the gondolas 420 and 422, respectively.

FIG. 5 is an illustration of the strut 313 depicted in the CRP Pod 302 of FIGS. 3A and 4A. Also illustrated is a steering module 502 connectable to the strut 313 for rotating the strut 313 to steer the marine vessel. FIG. 5 also depicts a boltable interface 500 at a bottom extremity of the strut 313 to form a water-tight interface along a lengthwise direction of the gondolas 402 and 408. The steering module 502 is similarly configured for boltable interface to the strut 313.

FIG. 6 is a detailed illustration of the gondolas 402 and 408 having respective boltable water-tight interfaces 600 and 602 positioned at extremities thereof. The water-tight connection between the boltable interfaces 500, 600, and 602 provide protection for maintenance workers as the gondolas 402 and 404 will be underwater during maintenance and testing.

FIG. 7 is a detailed cross-sectional view of connections between the boltable interfaces 500 of the CRP Pod 302 and the boltable interfaces 600 and 602 of the gondolas 402 and 408 depicted in FIGS. 5-6, respectively. In FIG. 7, a cutaway cross-sectional portion 700 of the strut 313 is shown, along with cutaway cross-sectional views 702 and 704 of the gondolas 402 and 408, respectively. During assembly, the boltable interfaces 600 and 602, near the top of the gondolas 402 and 408, form a bolted water-tight connection with the boltable interface 500 at the bottom of the strut 313. In the example of FIG. 7, the interface is secured via bolt type fasteners, although embodiments of the disclosure are not limited to bolts.

The boltable interfaces enables the gondolas 402 and 408, the strut 313, and the steering module 502 provide enhanced industrialization. For example, the gondolas 402 and 408, the strut 313, and the steering module 502 can be manufactured separately at reduced weights and can be tested using less complex test setups. For example, during testing it is desirable to separate the electric motors 314 and 316 (inside the gondolas 402 and 408) from the corresponding propellers 318 and 322, and from the strut 313. This approach permits the electric motors 314 and 316 to be tested without the propellers 318 and 322, allowing proper certifications to be obtained before the marine vessel goes out to sea.

After testing, the propellers 318 and 322 can be connected to the motors 314 and 316 and ultimately bolted to the strut 313. This reconnection will facilitate monitoring, for example, of the electrical connections of, and a supply of power to, the motors 314 and 316. Using this approach, pod propulsion systems will not require large test setups for lifting the complete CRP pod system. Instead, a smaller and less costly test setup can be used to test only the much lighter propeller modules 402 and 408 and not the entire CRP pod 302.

Figure 8:
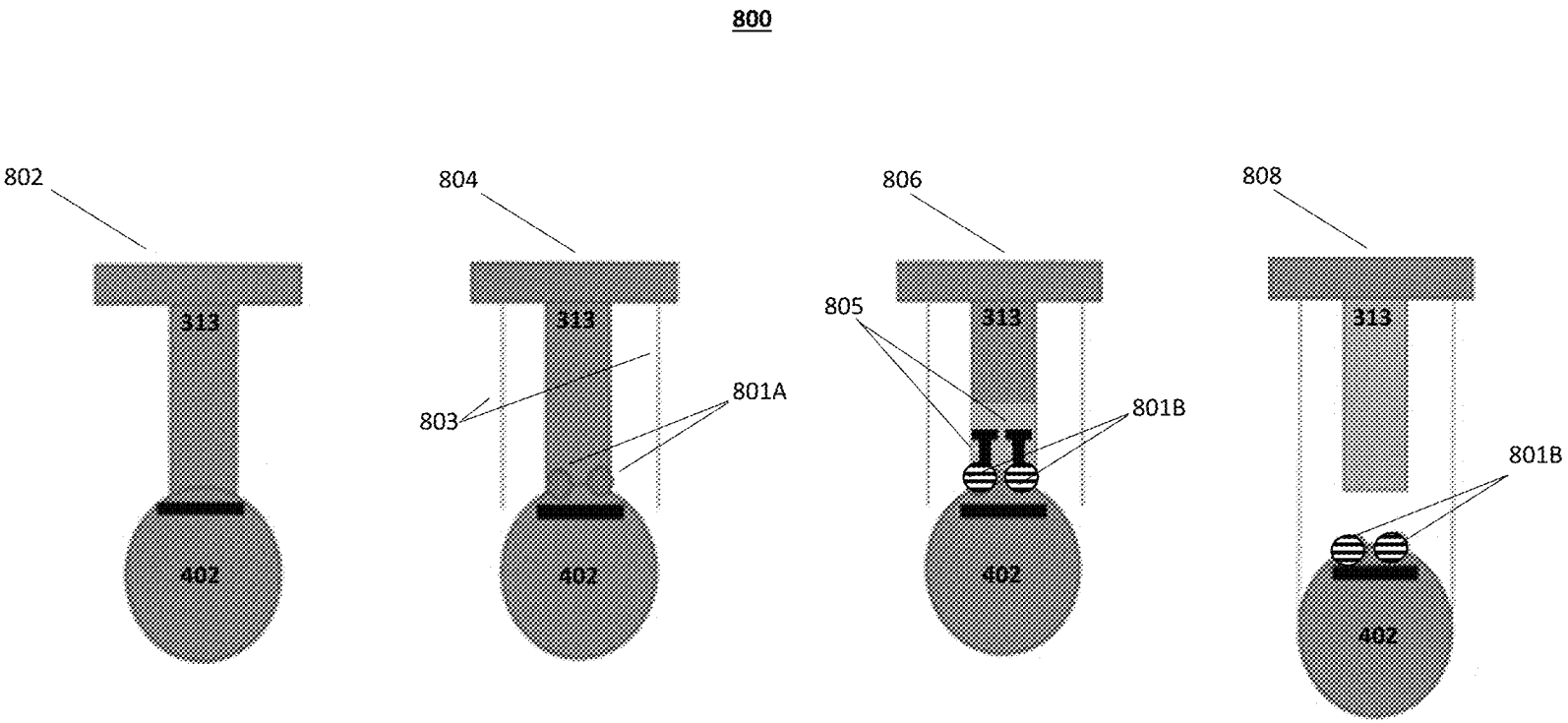
FIG. 8 is an illustration of exemplary steps for dislodging a pod propulsion module from a strut in a CRP pod propulsion system in accordance with the embodiments.

FIG. 8 is an illustration of an exemplary process 800 for dislodging the propeller modules 404 and 406 from the strut 313 of the CRP pod 302. The dislodging process 800 permits underwater changing of the gondolas 402 and/or 408 while in dry in dock. For example, the gondola 402 could be delivered for dry dock maintenance for quick and modular replacement. The dislodging process 800 provides a plug-and-play strategy that avoids changing the complete CRP pod 302 for most maintenance tasks. If one of the propeller modules 404 and 406 is damaged, for example, the damaged propeller module can be changed in the dry dock without dismounting the complete pod.

In one exemplary embodiment, the process 800 represents a method for underwater dislodging of the gondola 402 of the CRP pod 302 from the strut 313, disassembly and exchanging the strut 313. Before commencement of the process 800, seals 801*a* are positioned within the strut 313 in a vicinity of bolted connections, formed from the boltable interfaces 410A and 410B, for inflation at a later time. The bolted connections are sealed and water-tighted as depicted at 802, to facilitate floating. An external lifting system 803 is provided by the maintenance worker for securing the gondola 402 during the dislodging process as depicted at 804 and to facilitate floating.

The seals 801A are inflated to form inflated seals 801B that protect the maintenance worker. The fully inflated seals 801B provide the ability for a maintenance person to safely go inside the strut 313. Afterwards, bolts 805 can be removed, as depicted in 806. The bolts 805 are inside the CRP pod 302. After the bolts 805 are removed, the strut 313 can be pressurized to prevent water from entering. The gondola 402 is dislodged and lowered onto a dedicated cradle (not shown) or onto the seabed, as depicted in 808.

During an earlier preparation phase, preparatory steps are taken such as disconnecting cables and auxiliaries. A lid can be placed on the boltable interfaces 410A and 410B, making the propeller modules 404 and 406 watertight. As an example, a seal of the boltable interface 410A and 410B can be reinforced to facilitate releasing most of the bolts with maintenance personnel in the strut 313. A lifting arrangement can be attached to release most of the bolts holding the propeller modules 404 and 406 to a structure of the strut 313. Release of the final bolts can be performed remotely, permitting the lowering and removal of the propeller modules 404 and 406.

In one alternative to the process 800, both the module modules 404 and 406 and the strut 313 can be sealed at the interface (e.g., one cover plate for each). Watertight bolt connections can be used (in long tubes—or seals e.g., O-rings).

An alternative pod propulsion system implementation includes providing a CRP solution in azimuth mechanical thruster. This arrangement, for example, can similarly produce a thinner pod. Another approach could include two independent propulsors or one propulsor behind a main propeller.

Additional advantages include improved maintainability due to an ability to exchange propulsion modules with or without dry docks and because of smaller modules. The single bearing shaft line for each motor provides a very short and compact pod, reduces size and weight, and increases the hydrodynamic efficiency.

The embodiments provide improved fuel cost savings on the magnitude of at least 7% (5% for contra rotative propeller, a slender gondola, and 2% for PM motors). Reduced maintenance costs are provided due to increased access in the pod, and independent propulsion modules. Also provided is a capability to change propulsion modules afloat, even for large pods, as a result of a dedicated interface for the propulsion module and the strut.

The description herein is provided to enable a person skilled in the art to make or use the disclosure. Various modifications to the disclosure will be apparent to those skilled in the art, and the generic principles defined herein may be applied to other variations without departing from the scope of the disclosure. Thus, the disclosure is not limited to the examples and designs described herein but is to be accorded the broadest scope consistent with the principles and novel features disclosed herein.

What we claim is:

1. A pod propulsion system including first and second counter rotating propellers for propelling a marine vessel, comprising:

first and second propeller modules, each including a gondola, a propeller shaft, a single bearing and an electric motor having a driving-end configured to rotate the first and second counter rotating propellers, respectively, wherein both electric motors are disposed between the first and second counter rotating propellers;

first and second gondolas, each (i) for housing a respective one of the first and second electric motors and (ii) including a boltable interface, respectively formed along a lengthwise direction of an extremity thereof; and a strut (i) for connecting the first and second gondolas to a hull of the marine vessel (ii) including first and second boltable interfaces along an extremity thereof to connect directly to the extremities of the first and second gondolas;

wherein the first and second boltable interfaces of the strut are each configured to form a bolted joint interface with a corresponding one of boltable interfaces of the first and second gondolas.

2. The pod propulsion system of claim 1, wherein the bolted joint interfaces form a substantially horizontal watertight seal between the strut and the first and second gondolas.

3. The pod propulsion system of claim 1, wherein the bolted joint interfaces form a substantially vertical watertight seal between the strut and the first and second gondolas.

4. The pod propulsion system of claim 1, wherein the bolted joint interfaces of the first and second gondolas are formed on a top surface thereof.

5. The pod propulsion system of claim 1, wherein each of the first and second gondolas includes a watertight interface in a vicinity of their respective boltable interface.

6. The pod propulsion system of claim 1, wherein the first and second propellers can be dismounted from the respective first and second electric motors, the dismounting facilitating independent testing of the first and second motors without their respective first and second counter rotating propellers.

7. A counter rotating propeller pod (CRP) propulsion system including first and second counter rotating propellers for generating thrust to propel a marine vessel, comprising:

first and second propeller modules, each including:

an electric motor having a driving-end (i) connectable to a respective one of the first and second counter rotating propellers and (ii) configured to rotate the first and second counter rotating propellers about an axis of rotation, wherein both electric motors are disposed between the first and second counter rotating propellers, and a single bearing (i) for connecting the driving-end to the respective one of the first and second counter rotating propellers and (ii) configured to accommodate axial, radial and lever arm loads.

8. The CRP propulsion system of claim 7, wherein each of the electric motors is canned within one propulsion module.

9. The CRP propulsion system of claim 8, wherein each of the propulsion modules is sealed and exchangeable afloat.

10. The pod propulsion system of claim 1, wherein the single bearing is a slew bearing.

11. The pod propulsion of claim 10, wherein the single bearing is configured to provide a detachable connection between the electric motor and the first and second counter rotating propellers respectively.

12. A method for dislodging portions of a counter rotating propeller (CRP) pod propulsion system under-water, the system including at least one motor gondola housing an electric motor and connected to a strut of a propeller module via bolts in a bolted interface seal, the method comprising:

supplying one or more inflatable seals within the strut to reinforce the bolted interface seal;

water-tighting the bolted interface seal;

providing an external lifting system for securing the gondola during the dislodging; and removing the bolts under-water.

13. The method for dislodging of claim 12, wherein the removing includes inflating the inflatable seals.

14. The method for dislodging of claim 13, further comprising pressurizing the strut to dislodge the gondola from the strut.

15. The method of claim 12, wherein the bolts are removed by maintenance personnel in dry dock.

16. The method of claim 15, wherein the pressurizing and dislodging facilitate replacement of the dislodged gondola with another gondola.

17. The method of claim 16, wherein the CRP pod propulsion system is attached to a marine vessel; and wherein the external lifting system includes lifting and guiding tooling rods affixed to a hull of the marine vessel.

* * * * *